United States Patent [19]

Stiernspetz

[11] 4,372,549

[45] Feb. 8, 1983

[54] DEVICE AND A METHOD FOR WITHDRAWING ARTICLES IN THE FORM OF SHEETS FROM A STACK OF ARTICLES

[75] Inventor: Allan Stiernspetz, Björkö Nykil, Sweden

[73] Assignee: Datasaab AB, Jarfalla, Sweden

[21] Appl. No.: 256,172

[22] Filed: Apr. 21, 1981

[30] Foreign Application Priority Data

Apr. 25, 1980 [SE] Sweden ..... 8003174

[51] Int. Cl.[3] ..... B65H 3/30

[52] U.S. Cl. ..... 271/23; 271/119; 271/161

[58] Field of Search ..... 271/21, 22, 23, 119, 271/161

[56] References Cited

U.S. PATENT DOCUMENTS 715,764 12/1902 Dick ..... 271/23

2,280,964 4/1942 Mixer ..... 271/23

*Primary Examiner*—Richard A. Schacher

*Attorney, Agent, or Firm*—Sughrue, Mion, Zinn, Macpeak and Seas

[57] ABSTRACT

A device and a method for dispensing articles in the form of sheets from a supply. In order to dispense the articles, for example banknotes, from a supply in the form of a stack of banknotes, the outermost banknote of the stack is first displaced in one direction so that the banknote is made to form a bulge after its resistance to buckling has been overcome, whereupon the banknote is displaced in the opposite direction for being fed out from the dispensing device. The banknote is displaced by means of a withdrawal roller of appropriate shape, wherein the peripheral surface of said roller for example may be concave or convex and/or may be provided with helical projections for affecting the resistance of the banknote to buckling. In consequence of said bulge being formed in the banknote the latter will be effectively separated from the immediately following banknote of the stack, said separation being facilitated additionally by the design of the withdrawal roller.

7 Claims, 3 Drawing Figures

DEVICE AND A METHOD FOR WITHDRAWING ARTICLES IN THE FORM OF SHEETS FROM A STACK OF ARTICLES

BACKGROUND OF THE INVENTION

1. Field of the Invention

This invention refers to a device and a method for withdrawing articles in the form of sheets from a stack of articles.

Generally speaking the invention refers to a method and a device for dispensing articles in the form of sheets from a supply. For example, the articles may consist of banknotes, and an embodiment comprising banknotes will be described below, although the invention may be utilized in other articles in the form of sheets, for instance printed or unprinted sheets of paper, posters, etc.

2. Description of the Prior Art

Particularly in connection with banknotes it is of great importance that in dispensing the latter only one single banknote is dispensed at a time, as mistakes in payment may occur otherwise.

Many suggestions have earlier been made for reliably withdrawing banknotes one at a time from a supply in the form of a stack of banknotes. Rollers engaging the exposed banknote in a stack of banknotes have thus been utilized for thereby withdrawing said banknotes. Efforts have also been made to utilize the suction achieved by applying a vacuum for withdrawing banknotes one at a time.

As an example of the state of the art U.S. Pat. No. 3,572,691 may be mentioned. Said specification shows a supply of sheets in a magazine with a resiliently displaceable finger supported by a roller carrying along the outermost sheet in the magazine in such manner that the edge of said sheet passes by an edge of limitation in the magazine., The portion of the sheet carried along in this manner enters a recess in the roller behind the finger, and a second roller cooperating with the first one grips the edge of the sheet and withdraws the sheet from the magazine. This device requires the sheet to have a certain flexibility and will therefore not function in connection with for example banknotes which have been in circulation for a period of time and which may have sharp creases or flimsy structures.

It has turned out that all of the previously known devices have more or less pronounced deficiencies with respect to withdrawing banknotes of various qualities one by one from a supply with absolute accuracy.

The present invention approaches the relevant problem in another manner, and it has turned out that a device designed in accordance with the invention can handle most of the banknotes that may be found in the world, not only new ones but also banknotes which have been in circulation for a period of time.

SUMMARY OF THE INVENTION

Thus, the invention refers to a device and a method for withdrawing articles in the form of sheets, for example banknotes, one by one from a stack of said articles by the outermost article in the stack being acted upon, with the features of the invention being disclosed by the accompanying claims.

BRIEF DESCRIPTION OF THE DRAWING

The invention will be described more specifically below with reference to the accompanying drawing, in which.

DESCRIPTION OF THE PREFERRED EMBODIMENTS

Figure 1:
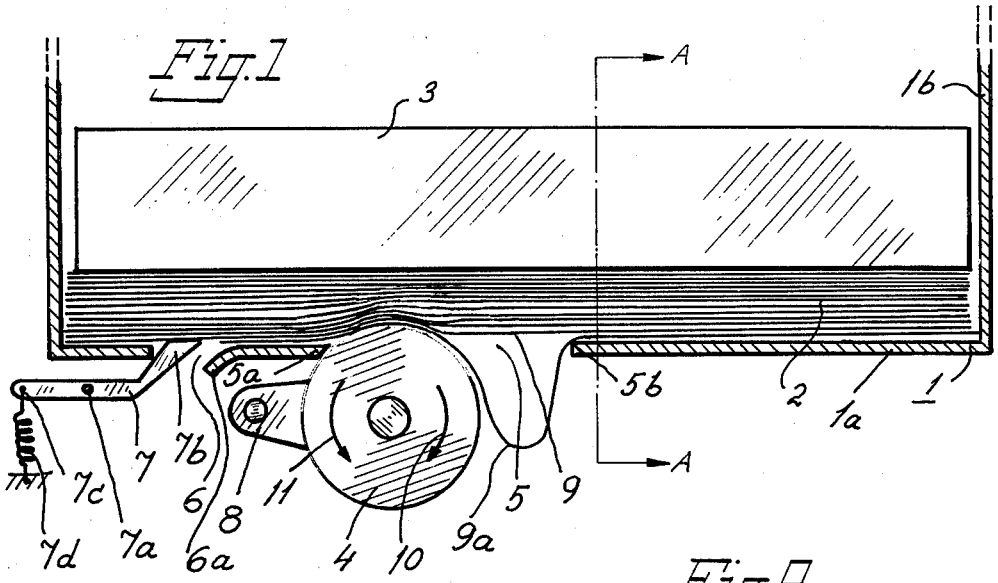
FIG. 1 shows a side elevational view, partly in section, of a magazine in accordance with the invention together with its associated feedout means.

In FIG. 1 the designation 1 indicates a magazine in which a stack 2 of banknotes is disposed, with the banknotes of the stack being urged against the bottom 1*a* of magazine 1 by a fairly heavy weight in the form of a plate 3. The bottom 1*a* of the magazine is not flat but slightly curved, for example in the form of a cylindrical segment or an elliptical segment. The bottom 1*a* of the magazine 1 is selectively adapted to the size of the relevant banknotes, and the banknote 9 of the stack of banknotes engaging said bottom is thus maintained urged against said bottom. Said bottom 1*a* is provided with a pair of openings 5 and 6, respectively, and the magazine is normally designed such, that said openings 5 and 6 extend over the width of the magazine, or otherwise said openings at least have such widths that they exceed the widths of the banknotes disposed in the magazine, as the banknotes are to be capable of emerging to a greater or lesser extent through said openings 5 and 6, respectively. The extensions of the openings 5 and 6, respectively, in the longitudinal direction of magazine 1 will be explained below.

As may be seen in FIG. 1 opening 6 is located close to the left limitation of magazine 1, said opening 6 being extended to a fairly small degree in the longitudinal direction of the magazine, i.e. counting from left to right in FIG. 1. Opening 6 may appropriately be terminated by a curved edge 6*a* so as to facilitate dispensing the banknote as will be seen in the following. In opening 6 there is a guide member which for example may consist of an arm 7 mounted in an appropriate place 7*a*, with one end 7*b* of said arm engaging that surface of the banknote 9 which is exposed in opening 6. The other end 7*c* of arm 7 is actuated by a spring 7*d*, and the lever ratios of arm 7 are such, that the end 7*b* is urged against said banknote surface.

The portion of arm 7 located closest to the end 7*b* has a more or less pronounced wedge shape with the point of the wedge facing the right of FIG. 1, and as will be seen from the following description the point of the wedge will be directed in the direction in which banknote 9 is displaced in the initial displacement of the banknote past opening 6. When the trailing edge of banknote 9 in this displacement has passed end 7*b* said end 7*b* will be made to apply its engagement force against the banknote lying immediately above the displaced banknote 9. In a following displacement of the first banknote in the opposite direction to the initial direction the end 7*b* will deflect the terminating end of the first banknote, whereby the banknote 9 will be deflected downwardly as viewed in FIG. 1. The curved edge 6*a* facilitates this deflection.

To the right of opening 6 as viewed in FIG. 1 and after opening 6 when counting with regard to the initial displacement of the first banknote 9 the bottom 1*a* of magazine 1 is provided with the above-mentioned second openings 5 which may have the same width as opening 6, i.e. a width being at least as great as the width of the banknote, with the length of opening 5 being substantially greater than the length of opening 6.

Adjacent the left edge 5*a* of opening 5 in accordance with FIG. 1 there is disposed a withdrawal roller 4 consisting of rubber or some other appropriate elastomeric friction material, and the distance between the point of engagement of this withdrawal roller 4 against banknote 9 and the edge 5*b* of opening 5 located furthermost to the right of FIG. 1 is sufficiently large for banknote 9 to be capable of emerging from opening 5 in the form of a bulge 9*a* when banknote 9 is displaced to the right of FIG. 1 by withdrawal roller 4.

Figure 2:
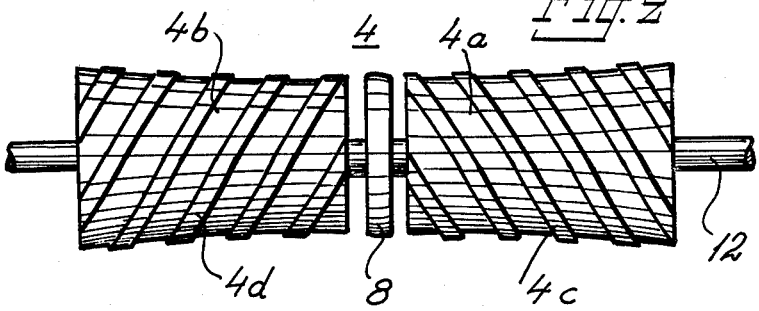
FIG. 2 shows an embodiment of a withdrawal roller utilized for the feedout.

This displacement of the portion of banknote 9 located at withdrawal roller 4 is carried out by withdrawal roller 4 being made to rotate clockwise as is indicated by means of arrow 10. The existence of bulge 9*a* is associated with the buckling rigidness (i.e. the resistance to buckling) of banknote 9. The desired magnitude of the buckling rigidness is to compensate for the difference in friction between the second and third banknotes and between the first and second banknotes, respectively, in the case of the first-mentioned friction being the smaller one. If this does not occur two banknotes will form a bulge. Furthermore, the buckling rigidness must not be so great that it cannot be overcome by the friction between the banknote which is being withdrawn and the withdrawal roller. A plurality of methods can be utilized for achieving the required buckling rigidness. In accordance with one of these methods withdrawal roller 4 is designed in such manner that, as may be seen in FIG. 2, it preferably has two subrollers 4*a* and 4*b* secured to the same saft 12, with the transverse contour of said subrollers following the transverse contour of a cylinder segment. Subrollers 4*a* and 4*b* are separated by an intermediate spacing in which a metering wheel 8 is disposed for being used for defining the position of banknote 9. Bottom plane 1*a* may have a shape mating with the shape of withdrawal roller 4, i.e. the shape of a cylinder segment. The buckling rigidness of banknote 9, which determines the mode of operation of a high degree, is influenced by the design of withdrawal roller 4, wherein a concave withdrawal roller increases the buckling rigidness of banknote 9 whereas a convex withdrawal roller provides banknote 9 with a still higher buckling rigidness. Also, the length of opening 5 influences the buckling rigidness.

It has turned out that the mode of operation of the device described above can be improved by withdrawal roller 4, or the portions 4*a* and 4*b* of the withdrawal roller in the described case, being lended an additional shape besides the mentioned concave and convex shapes.

The two subrollers 4*a* and 4*b* are thus provided with raised portions 4*c* and 4*d*, respectively, which appropriately may take the form of screw threads. In the embodiment of FIG. 1 screw thread 4*c* of subroller 4*a* is threaded to the right, whereas the screw thread 4*d* of subroller 4*b* is threaded to the left. In other words, when subrollers 4*a* and 4*b* are rotated in the direction of arrow 10 banknote 9 will be affected in such manner, if desired by the subrollers slipping, that its width will be decreased by the respective screw threads each conveying a side portion of banknote 9 towards the middle of said banknote. In this manner an advantageous influence of the buckling rigidness is achieved by the accuracy of one single banknote involved in each withdrawal increasing additionally.

Figure 3:
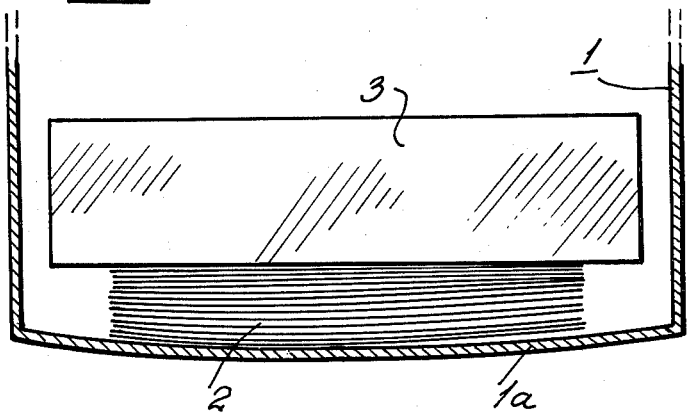
FIG. 3 is a sectional view taken along the line A—A of FIG. 1.

FIG. 3 shows a sectional view taken along line A—A of FIG. 1, wherein the magazine is illustrated with the banknote stack 2 disposed therein engaging the bottom 1*a* of the magazine in consequence of plate 3. In the illustrated case bottom plate 1*a* of the magazine is convex, and for example it may take the form of a cylinder segment.

The device described above operates in the following manner, as best may be seen in FIG. 1. The banknote 9 located most closely to bottom plate 1*a* is substantially rectilinear and extends from the vicinity of the left edge of magazine 1 to the right edge 1*b* of magazine 1. This banknote 9 is visible both in opening 6 and in opening 5. Withdrawal roller 4 is now rotated clockwise, as is indicated by means of arrow 10, so that the portion of banknote 9 located opposite to withdrawal roller 4 is affected in such manner that the left portion of said banknote, which is disposed between withdrawal roller 4 and the left side of magazine 1, is drawn from left to right. Thus banknote 9 is displaced past opening 6 and past the end 7*b* of arm 7. Simultaneously the portion of banknote 9 located on the right side of withdrawal roller 4 will be displaced to the right. If banknote 9 at the right portion of magazine 1 at that time is not retained in position in consequence of the friction between banknote 9 and the banknote lying thereabove under the influence of pressure plate 3 at least the right edge of banknote 9 will strike the right edge 1*b* of the magazine and will be stopped there. After the buckling rigidness of the banknote has been overcome, said buckling rigidness being influenced by the shape of withdrawal roller 4 and bottom plate 1*a* of the magazine, banknote 9 will in the continued rotation of withdrawal roller 4 in the direction of arrow 10 take the shape of a bulge 9*a* emerging from opening 5 in the manner illustrated by FIG. 1, i.e. away from the following banknote which is located adjacent banknote 9. By means of a sensing device (not shown), which if desired may consist of metering wheel 8 but alternatively can take the form of photocell device or some other appropriate device, sensing is carried out when bulge 9*a* has become sufficiently great for the left end of banknote 9 to have passed the end 7*b* of guide member 7. When this position of banknote 9 having bulge 9*a* has been reached the direction of rotation of withdrawal roller 4 is reversed, with banknote 9 then being displaced in direction from right to left. The left end of banknote 9 is then made to emerge from opening 6 by means of the end 7*b* of guide member 7 and approximately follows the curved edge 6*a*. The bulge 9*a* of banknote 9 is evened out, i.e. it becomes smaller, in the continued rotation of the withdrawal roller in the direction of arrow 11, and thereafter the portion of banknote 9 located to the right of the edge 5*b* of opening 5 is also conveyed along, and therefore the entire banknote 9 will be conveyed out through opening 6. When an indication that the entire banknote 9 has emerged through opening 6 in direction from right to left has been provided, which can be done by means of metering wheel 8 or by means of some other appropriate sensing device (not shown), the direction of rotation of withdrawal roller 4 is again reversed so as to be the direction illustrated by arrow 10. The banknote which earlier has been disposed adjacent to the banknote 9 in banknote stack 2 will now be displaced from the left to the right by means of withdrawal roller 4, and the procedure described above will be repeated with respect to the banknote which now is exposed in openings 5 and 6. Thereafter the same procedure is repeated with regard to the additional banknotes disposed in the banknote stack 2 of the magazine, and thus these banknotes will be dispensed one by one.

It should be clear that it is characteristic of the present invention that a banknote first is displaced in a first direction under such conditions that by overcoming the buckling rigidness of the banknote only one single banknote is made to bulge, whereafter the banknote is displaced in the opposite direction for being dispensed from the withdrawal device. This is achieved by withdrawal roller 4 and bottom plate 1*a* as well as opening 5 being designed in appropriate manner in accordance with the above.

The embodiment of the invention described above is not intended to comprise a limitation, and modifications can be carried out within the scope of the claims. Hence it is not necessary to withdraw banknote 9 after displacement in the first direction from left to right by letting banknote 9 emerge through opening 6 in the second displacement in the direction from right to left. For example, withdrawal roller 4 may be disengaged, and a suction device may be permitted to engage banknote 9 at bulge 9*a* for withdrawing the banknote in this manner.

I claim:

1. In a device for withdrawing articles individually from a stack of articles in the form of sheets, specifically banknotes, said devices including a magazine for receiving a stack of discrete articles in the form of sheets and having a bottom surface supporting said stack, a transverse width at least equal to the width of said articles, and a length at least equal to the length of said articles, said bottom surface defining two transverse openings each having a width at least equal to the width of said articles, and elongated roller means disposed in one of said openings and outside of the magazine for engaging an exposed article of the stack, said roller means being disposed to rotate first in one direction so that a bulge extending through said one opening is formed in said exposed article and thereafter in an opposite direction so that said exposed article is dispensed through the other opening, the improvements characterized by:

(a) the bottom surface of the magazine having the shape of a cylindrical segment adjacent to said one opening in a transverse direction, and (b) the longitudinal contour of the roller means having the shape of a cylindrical segment complementary to that of the bottom surface of the magazine.

2. A device in accordance with claim 1, wherein said roller means comprises a cylinder of rotation having a longitudinal contour selected from the group consisting of convex and concave, and the bottom surface of the magazine has a transverse contour selected from the group consisting of concave and convex, respectively, which mates with the contour of said roller means.

3. A device in accordance with claim 2, wherein said roller means consists of an elastomeric frictional material, such as rubber.

4. A device in accordance with claim 2, wherein said roller means comprises two subrollers mounted on a common shaft, said subrollers comprising mirror images of each other and being provided on their circumferences with helical elevations wound in opposite directions for subjecting the article to pressure towards its longitudinal intermediate area in the rotation of the subrollers so as to increase the buckling resistance of the article.

5. A device in accordance with claim 4, wherein a metering roller is disposed between the two subrollers, said metering roller being driven by said article when being displaced for determining the relative position of the article in its displacement.

6. A method of withdrawing articles individually from a stack of articles in the form of sheets, specifically banknotes, by engaging the outermost article of the stack, comprising the steps of:

(a) imparting the shape of a cylindrical segment to said outermost article in a transverse direction to thereby increase the buckling resistance of the article in a longitudinal direction, (b) applying a force to said article in said longitudinal direction to displace it until a bulge overcoming said increased buckling is formed in the article, said force being uniformly applied to said article across its width, and (c) displacing said article in an opposite longitudinal direction to effect its withdrawal.

7. A method in accordance with claim 6, wherein two opposing forces affect the article mutually simultaneously and prior to or simultaneously with the engagement force at substantially right angles to the engagement force so as to achieve buckling at right angles to said bulge.

* * * * *